United States Patent [19]

Imamura et al.

[11] Patent Number: 5,016,586

[45] Date of Patent: May 21, 1991

[54] APPARATUS FOR CONTROLLING A THROTTLE VALVE

[75] Inventors: Kazunori Imamura, Fukuoka; Yoshikazu Hoshi, Ibaraki, both of Japan

[73] Assignees: Hitachi, Ltd., Tokyo; Hitachi Automotive Engineering Co., Ltd., Ibarabi, both of Japan

[21] Appl. No.: 438,015

[22] Filed: Nov. 20, 1989

[30] Foreign Application Priority Data

Nov. 30, 1988 [JP] Japan ..... 63-300579

[51] Int. Cl.[5] ..... F02D 9/00

[52] U.S. Cl. ..... 123/336; 123/337

[58] Field of Search ..... 123/336, 337

[56] References Cited

U.S. PATENT DOCUMENTS

| | | | |
|---|---|---|---|
| 4,462,357 | 7/1984 | Lockhart | 123/336 |
| 4,872,435 | 10/1989 | Ueyama et al. | 123/336 |
| 4,892,071 | 1/1990 | Asayama | 123/336 |

*Primary Examiner*—Raymond A. Nelli

*Attorney, Agent, or Firm*—Antonelli, Terry, Stout & Kraus

[57] ABSTRACT

An apparatus for controlling a throttle valve comprises a motor for rotating a throttle valve so as to adjust the valve opening degree, a gearing disposed between the motor and the throttle valve for transmitting driving force of the motor to the throttle valve, and a return device serving to return the throttle valve to a regular set position thereof. The return device includes a tension spring.

9 Claims, 4 Drawing Sheets

APPARATUS FOR CONTROLLING A THROTTLE VALVE

BACKGROUND OF THE INVENTION

The present invention relates to an apparatus for controlling a throttle valve of an engine and, more particularly, to an apparatus for controlling a throttle valve of which the valve opening degree is controlled by a motor.

The valve opening degree of the throttle valve of the engine is generally controlled by mechanical connecting means, such as a cable or a linkage connected to an accelerator pedal. In recent years, however, there has been proposed a controlling device in which the step-on amount of the accelerator pedal is electrically converted and the valve opening degree is controlled by driving a motor for driving the throttle valve in correspondence to the converted amount. In this controlling device, a valve return means is needed in order to permit the throttle valve to return to its regular set position when the motor is not driven. As the valve return means, a torsion coil spring is used into which an extended portion of the shaft of the throttle valve is inserted and which is fixed to the shaft at its one end and to the housing at its other end. In this torsion coil spring, a large hysteresis exists in the spring characteristic thereof due to contact friction between the inside surface of the spring and the shaft and due to contact friction between adjacent lines of the spring, and furthermore, once the valve begins to move, the friction developed in the spring is changed from static friction to kinetic friction so as to be reduced. In consequence, when it is intended, for example, to control the valve to open it at a valve opening degree of which the spring return force is greater than the present valve opening degree, the valve cannot begin to move unless the output power of the motor becomes larger than the resultant force of the spring return force and the frictional force. However, there is a disadvantage that once the valve begins to move, the output power of the motor becomes excessively large because the friction is changed from static friction to kinetic friction as described above.

On the other hand, in the control of the valve opening degree of the throttle valve of the kind described above, it is usual to apply at least PI control, out of PID control, so as to minimize the error of the command valve opening degree.

In order to quickly reach the command valve opening degree, in other words, in order to obtain a quick control response ability, it is enough to make large the gain of the I control. However, since the frictional force becomes smaller after the valve begins to move as described above, the gain of the I control becomes larger than is required. In consequence, the valve greatly overshoots the command valve opening degree, thereby making it impossible to obtain a high controlling accuracy. In order to obtain the derived controlling accuracy, it is sufficient to make small the gain of the I control. In this case, however, it is impossible to obtain the quick control response ability. Accordingly, the existing throttle valve makes a compromise in respect of both the controlling accuracy and the control response ability since it is difficult to obtain an excellent controlling accuracy and an excellent control response ability concurrently.

SUMMARY OF THE INVENTION

An object of the present invention is to provide an apparatus for controlling a throttle valve which exhibits both an excellent accuracy of controlling the valve opening degree and an excellent control response ability.

An apparatus for controlling a throttle valve according to the present invention comprises a motor for rotating the throttle valve so as to adjust the valve opening degree, a gearing disposed between the motor and the throttle valve for transmitting the driving force of the motor to the throttle valve, and a return means including a tension spring and serving to return the throttle valve to a regular set position thereof.

The return means includes a first spring support portion provided on a gear secured to the throttle valve and a second spring support portion provided on a housing which envelops the gearing so that the tension spring is stretched between these two spring support portions. At least one of these spring support portions is rotatable. It is preferable that the rotatable spring support portion is the first spring support portion. The first and second spring support portions are so arranged that the torque applied to the throttle valve by the tension spring has a maximum at a position of intermediate valve opening degree between a full-open position and a full-closed position of the throttle valve. In other words, the torque of the valve is set to be small in the vicinity of the full-open and full-closed positions. In an embodiment, this controlling apparatus is applied to an auxiliary throttle valve of a tandem throttle valve, and the regular set position is a full-open position of the auxiliary throttle valve.

The above construction contributes to reduction of the hysteresis due to the frictional force of the return means and to reduction of the decrease of the frictional force after the valve begins to move, and therefore, it is possible to make large the gain of the I control without allowing it to become excessively large after the valve begins to move, thereby making it possible to obtain excellent positional controlling accuracy and control response ability.

Furthermore, in the tandem throttle valve according to the above embodiment, since the auxiliary throttle valve is used regularly at opening degrees around its full-closed position at which the valve closing torque can be made small, it is possible to make smaller the motor in this embodiment than in the conventional apparatus.

DESCRIPTION OF THE PREFERRED EMBODIMENT

Description will be given of an embodiment of a throttle valve controlling apparatus according to the present invention when it is applied to an auxiliary throttle valve of a tandem throttle valve, with reference to FIGS. 1 to 5.

Figure 1:
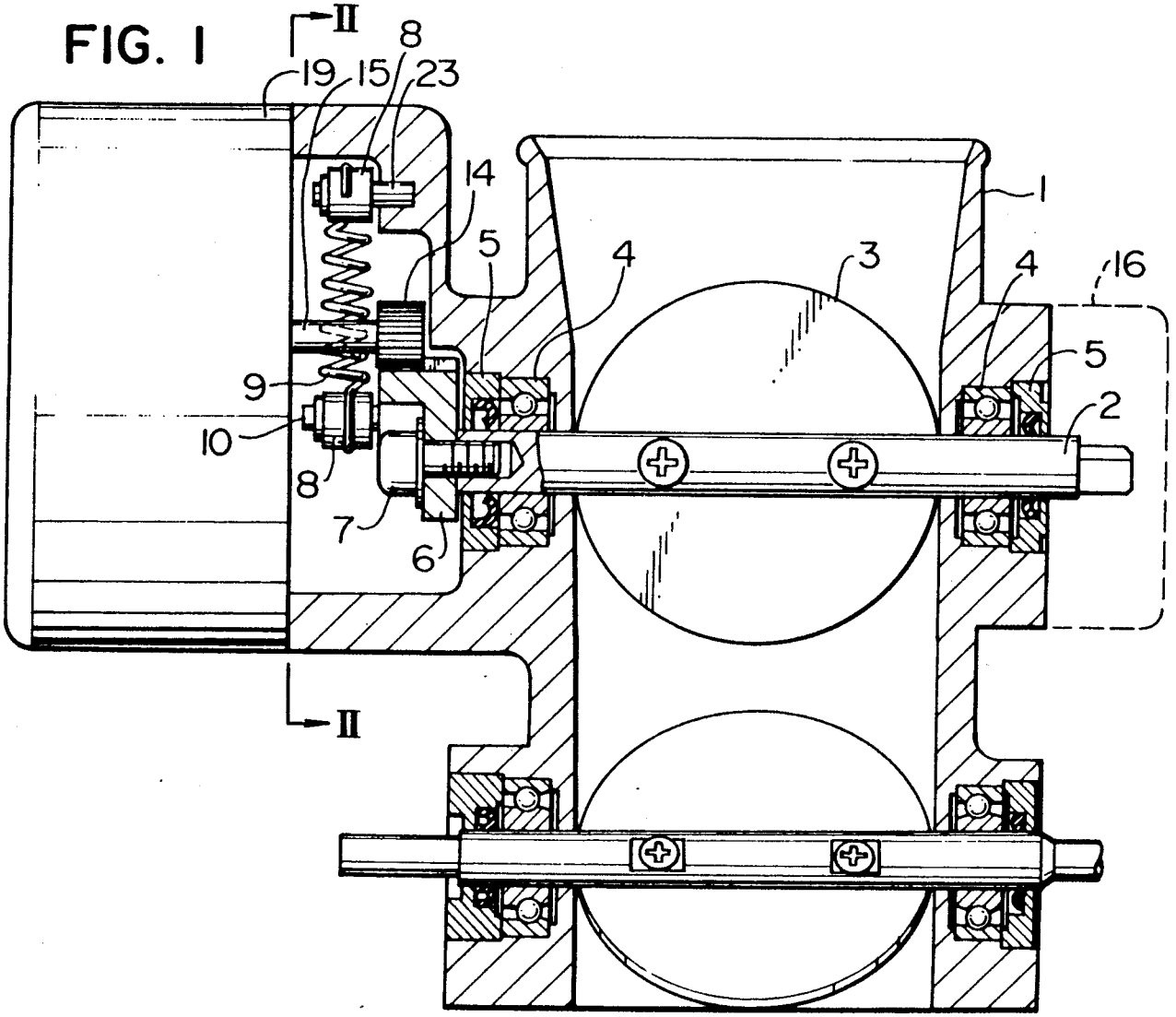
FIG. 1 is a vertical sectional view of a tandem throttle valve including an auxiliary throttle valve to which a throttle valve controlling apparatus according to the present invention is applied.
Figure 2:
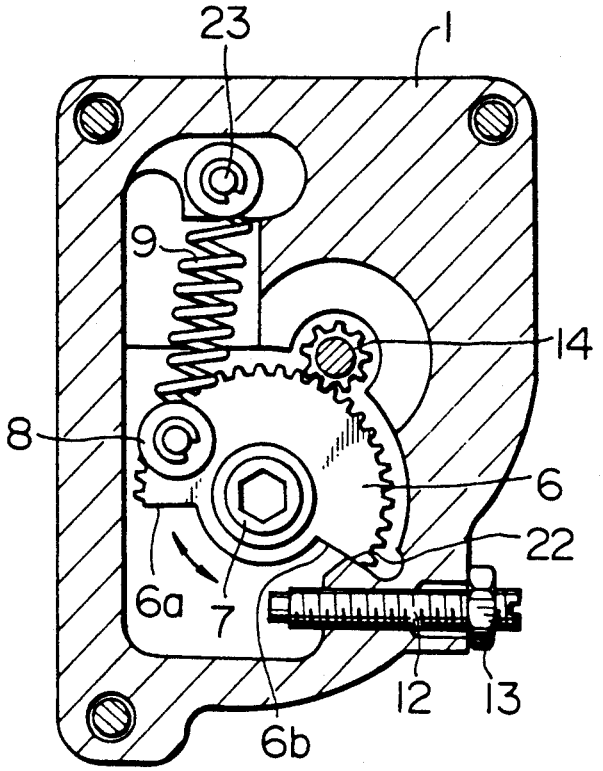
FIG. 2 is a sectional view taken along line II—II in FIG. 1.
Figure 3:
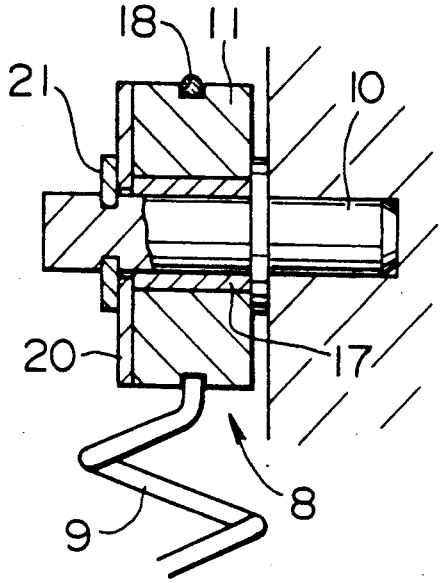
FIG. 3 is a sectional view of a rotatable spring support portion of the throttle valve controlling apparatus according to the present invention.
Figure 4:
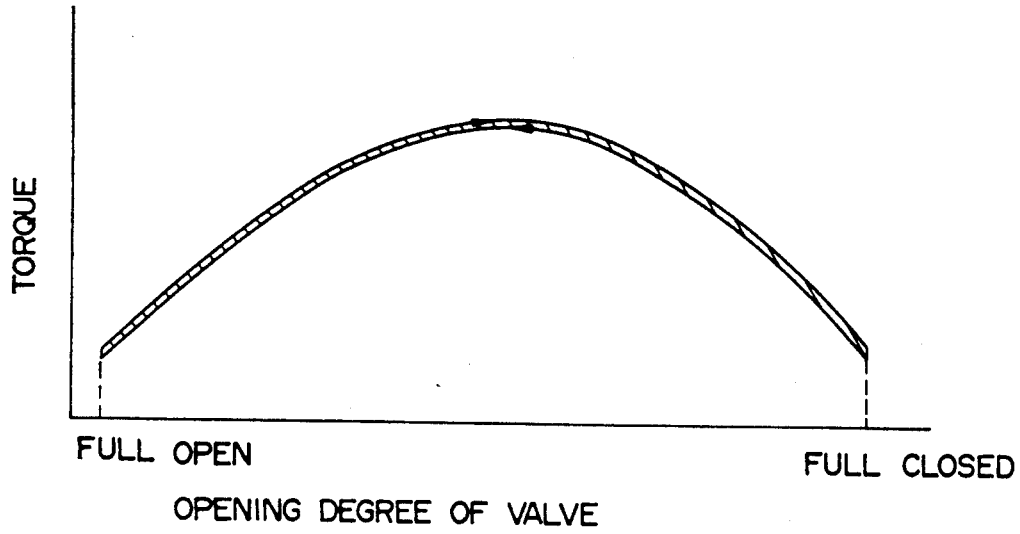
FIG. 4 is a diagram showing the torque of the auxiliary throttle valve shown in FIG. 1.
Figure 5:
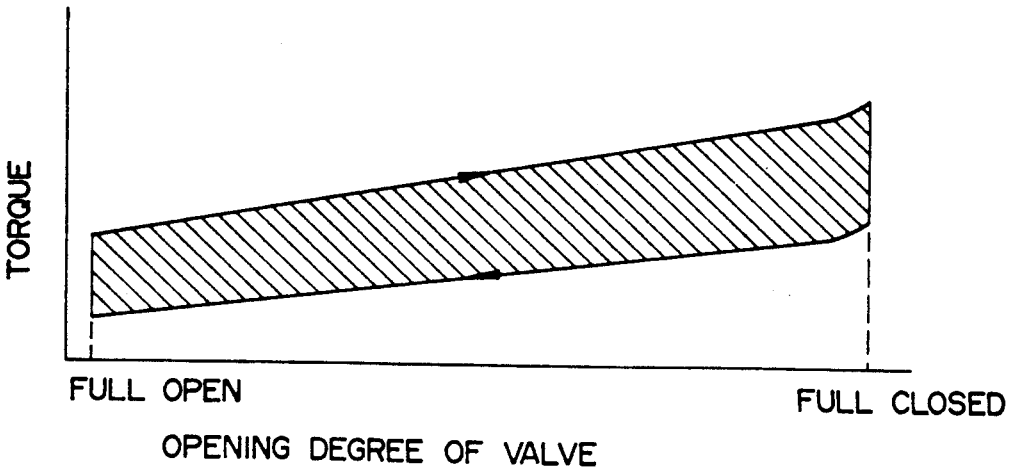
FIG. 5 is a diagram showing the torque of a conventional throttle valve which uses a torsion coil spring.

An auxiliary throttle shaft 2 extends through a housing 1 which constitutes a throttle chamber. The auxiliary throttle shaft 2 is rotatably supported by means of bearings 4. A dust seal 5 is fitted on the outward portion of each bearing 4. A valve 3 is fixed to the auxiliary throttle shaft 2 in the middle portion thereof. Ends of the auxiliary throttle shaft 2 extend outside the housing 1, one of them being combined with a throttle sensor 16 which serves to detect the valve opening degree, while the other has a sector gear 6 secured thereto with a bolt 7. The sector gear 6 is kept in meshing engagement with a pinion 14 which is secured to an output shaft 15 of a motor 19 fixed to the housing 1. A first spring support shaft 10 is mounted on the side surface of the sector gear 6 and a second spring support shaft 23 is mounted on the housing 1. A tension spring 9 is stretched between the first and second spring support shafts 10 and 23 so as to urge the valve 3 to be biased toward its full-open position. The first and second spring support shafts 10 and 23 are positioned in such a manner that the torque applied to the valve 3 by the tension spring 9 has a maximum at an intermediate position between the full-open and full-closed positions of the valve, as shown in FIG. 4. A spring support device 8 is fitted on each of the first and second spring support shafts 10 and 23. The spring support device 8 has a bush 17 rotatably fitted on the first or second spring support shaft 10, 23, a spring holder 11 secured onto the bush 17, a washer 20 rotatably fitted on the first or second spring support shaft 10, 23, and a retaining ring 21 serving to hold the washer 20 and the spring holder 11 on the first or second spring support shaft 10, 23. A circumferential groove 18 is formed on an outer peripheral surface of the spring holder 11, the hooked portion of the tension spring 9 being engaged with the circumferential groove 18.

A full-closing stopper 12 is adjustably screwed in the housing 1 so that its forward end abuts against an end surface **6*a* of the sector gear 6 when the valve is full closed. A positioning nut 13 is screwed on the full-closing stopper 12 so as to fix the latter. Further, the housing 1 is formed with an abutting surface 22 which abuts against another end surface 6*b* of the sector gear 6** when the valve is full opened.

Usually, the auxiliary throttle valve is urged to be biased toward its open position by means of the tension spring 9 so that the end surface **6*b* of the sector gear 6 is kept in contact with the abutting surface 22 of the housing 1. As the motor 19 is driven to transmit its power to the sector gear 6 through the pinion 14, the valve 3 is rotated against the force of the tension spring 9 to reach a desired valve opening degree. As described before, since the tension spring 9 is used as the return spring for returning the valve to its regular position or, in the present embodiment, to its full-open position, it is prevented from suffering the friction between adjacent lines and the contact friction with respect to the throttle shaft 2, differently from the torsion coil spring used in the prior art. Accordingly, as shown in FIG. 4, the torque characteristic of the valve exhibits a smaller hysteresis as compared with that of the conventional torsion coil spring (shown in FIG. 5), thus contributing to reduction of the decrease of the frictional force after the valve begins to move. In consequence, it is possible to make large the gain of the I control without allowing it to become excessively large after the valve begins to move, and accordingly, it is possible to obtain excellent positional controlling accuracy and control response ability. Further, in the tandem throttle valve, the auxiliary throttle valve is used regularly at opening degrees around its full-closed position at which the torque of the valve is small as shown in FIG. 4**. It is therefore possible to use a smaller motor than in the conventional apparatus.

In the embodiment described above, both the first and second spring support shafts 10 and 23 have the spring support device 8 fitted thereon, however, the spring support device 8 may be fitted on the first spring support shaft 10 alone. Further, the tension spring 9 may be stretched directly between the first and second spring support shafts 10 and 23 without providing any spring support device 8 although the frictional force is a little increased.

Figure 6:
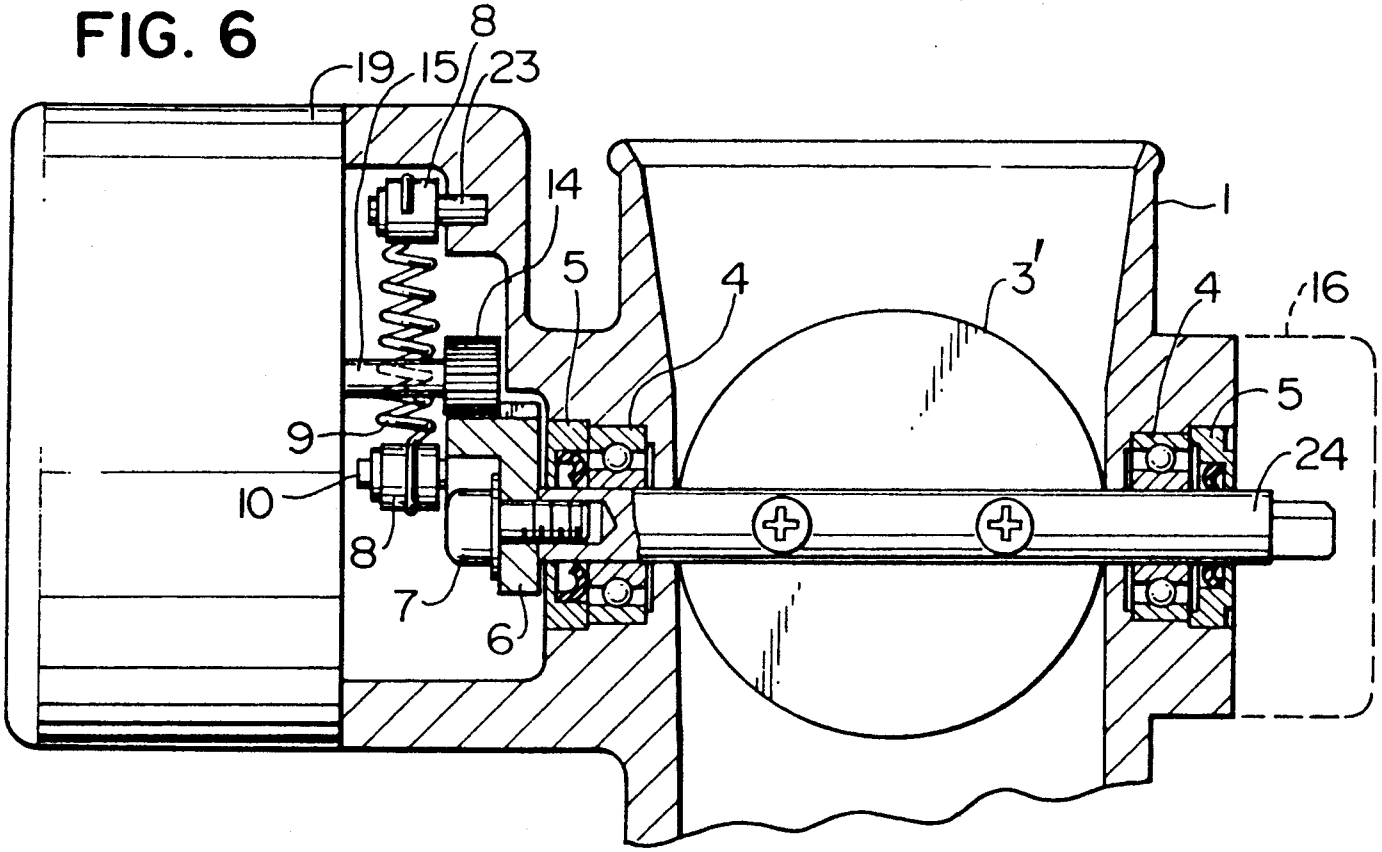
FIG. 6 is a sectional view of a single throttle valve to which a throttle valve controlling apparatus according to the present invention is applied.

FIG. 6 shows a single throttle valve to which a throttle valve controlling apparatus according to the invention is applied. In the embodiment, the tension spring 9 is stretched so as to bias a valve 3' fixed on a throttle shaft 24 to a full-closed position thereof unlike the above described embodiment and other structure is almost the same as the above described embodiment.

What is claimed is:

1. An apparatus for controlling a throttle valve, comprising:

a motor for rotating a throttle valve so as to adjust the valve opening degree;

a gearing disposed between said motor and said throttle valve for transmitting driving force of said motor to said throttle valve; and a return means for serving to return said throttle valve to a regular set position thereof and including a tension spring, wherein said return means includes a first spring support portion provided on a gear secured to said throttle valve and a second spring support portion provided on a housing which envelopes said gearing so that said tension spring is stretched between said two spring support portions.

2. A throttle valve controlling apparatus according to claim 1, wherein at least one of said spring support portions is rotatable.

3. A throttle valve controlling apparatus according to claim 2, wherein said rotatable spring support portion is said first spring support portion.

4. A throttle valve controlling apparatus according to claim 1, wherein said first and second spring support portions are so arranged that the torque applied to said throttle valve by said tension spring has a maximum at a position of intermediate valve opening degree between a full-open position and a full-closed position of said throttle valve.

5. A throttle valve controlling apparatus according to claim 1, wherein said regular set position is a full-closed position of said throttle valve.

6. A throttle valve controlling apparatus according to claim 1, wherein said controlling apparatus is incorporated in an auxiliary throttle valve of a tandem throttle valve.

7. A throttle valve controlling apparatus according to claim 6, wherein said regular set position is a full-open position of said auxiliary throttle valve.

8. An apparatus for controlling a throttle valve, comprising:

a motor for rotating a throttle valve so as to adjust the valve opening degree;

a gearing disposed between said motor and said throttle valve for transmitting driving force of said motor to said throttle valve; and a return means for serving to return said throttle valve to a regular set position thereof and including a tension spring, extending between support portions located so that the torque applied to said throttle valve by said tension spring has a maximum value at a position of intermediate valve opening degree between a full-open position and a full-closed position of said throttle valve.

9. A throttle valve controlling apparatus according to claim 8, wherein one of said support portions is rotatable.

* * * * *